US009345077B2

(12) United States Patent
Peng

(10) Patent No.: US 9,345,077 B2
(45) Date of Patent: May 17, 2016

(54) LIGHT EMITTING DIODE DRIVING APPARATUS

(71) Applicant: Semisilicon Technology Corp., New Taipei (TW)

(72) Inventor: Wen-Chi Peng, New Taipei (TW)

(73) Assignee: Semisilicon Technology Corp., New Taipei (TW)

( * ) Notice: Subject to any disclaimer, the term of this patent is extended or adjusted under 35 U.S.C. 154(b) by 0 days.

(21) Appl. No.: 14/336,604

(22) Filed: Jul. 21, 2014

(65) Prior Publication Data

US 2016/0021710 A1 Jan. 21, 2016

(51) Int. Cl.

*H05B 39/00* (2006.01)
*H05B 37/00* (2006.01)
*H05B 33/08* (2006.01)

(52) U.S. Cl.

CPC ..... *H05B 33/0809* (2013.01); *H05B 33/0821* (2013.01)

(58) Field of Classification Search

CPC ..... H05B 33/0803; H05B 33/0857; H05B 33/0842; H05B 37/029; H05B 33/0824
USPC ..... 315/185 S, 185 R, 192, 193, 161
See application file for complete search history.

(56) References Cited

U.S. PATENT DOCUMENTS

| | | | | |
|---|---|---|---|---|
| 3,320,436 | A * | 5/1967 | Sharples | 327/227 |
| 2002/0135315 | A1 * | 9/2002 | Puleo et al. | 315/185 R |
| 2012/0098444 | A1 * | 4/2012 | Peng | 315/193 |
| 2014/0035481 | A1 * | 2/2014 | Peting | H05B 37/0245 315/291 |

OTHER PUBLICATIONS

Patrick, Dale R. Fardo, Stephen W.. (2008). Electricity and Electronics Fundamentals (2nd Edition). Fairmont Press, Inc.. Online version available at: http://app.knovel.com/hotlink/toc/id:kpEEFE0003/electricity-electronics/electricity-electronics.*

Semiconductor Components Industries Application Hints for Transient Voltage Suppression Diode Circuits http://www.onsemi.com/pub_link/Collateral/AND8230-D.PDF.*

* cited by examiner

*Primary Examiner* — Alexander H Taningco
*Assistant Examiner* — Renan Luque
(74) *Attorney, Agent, or Firm* — Muncy, Geissler, Olds & Lowe, P.C.

(57) ABSTRACT

A light emitting diode driving apparatus includes a first light emitting diode driving unit and a second light emitting diode driving unit. The first light emitting diode driving unit includes a plurality of first light emitting diode driving subunits in series. The second light emitting diode driving unit includes a plurality of second light emitting diode driving subunits in series. The first light emitting diode driving unit and the second light emitting diode driving unit are electrically connected in parallel to receive a direct current power. A light signal is transmitted between the first light emitting diode driving unit and the second light emitting diode driving unit in series.

11 Claims, 4 Drawing Sheets

LIGHT EMITTING DIODE DRIVING APPARATUS

BACKGROUND OF THE INVENTION

1. Field of the Invention

The present invention relates to a light emitting diode driving apparatus, and especially relates to an improved light emitting diode driving apparatus.

2. Description of the Related Art

Nowadays, the connection types of the light emitting diode lamp string modules are separated into two types: the serial-type connection and the parallel-type connection. The light emitting diode lamp string modules are widely used for external walls of the building, decoration of trees, signboards, and scenery designing.

In the related art serial-type light emitting diode lamp string modules, a plurality of light emitting diode lamp string modules are commonly connected in series. Also, the amount of the light emitting diode lamp string modules is determined according to the volume of the decorated objects. In addition, all of the light emitting diode lamp string modules are controlled by the same controller which initially controls the first light emitting diode lamp string module.

The parallel-type light emitting diode lamp string modules are connected to the controller in parallel. Accordingly, each one of the light emitting diode lamp string modules is controlled by the controller through a control line and an address line, respectively. For example, ten control lines and ten address lines need to be used when ten light emitting diode lamp string modules are employed to be connected in parallel.

Both the related art serial-type light emitting diode lamp string module and the related art parallel-type light emitting diode lamp string module have different advantages and disadvantages. However, it is a pity that currently there is no product combining both the related art serial-type light emitting diode lamp string module and the related art parallel-type light emitting diode lamp string module.

SUMMARY OF THE INVENTION

In order to solve the above-mentioned problems, an object of the present invention is to provide a light emitting diode driving apparatus.

In order to achieve the object of the present invention mentioned above, the light emitting diode driving apparatus is applied to an alternating current power supply apparatus, an alternating current to direct current power supply apparatus and a plurality of light emitting diodes. The alternating current power supply apparatus sends an alternating current power to the alternating current to direct current power supply apparatus. The alternating current to direct current power supply apparatus converts the alternating current power into a direct current power. The light emitting diode driving apparatus comprises a direct current power input contact, a light signal control unit, a first light emitting diode driving unit and at lease a second light emitting diode driving unit. The direct current power input contact is electrically connected to the alternating current to direct current power supply apparatus to receive the direct current power. The light signal control unit is electrically connected to the direct current power input contact. The first light emitting diode driving unit is electrically connected to the direct current power input contact, the light emitting diodes and the light signal control unit. The second light emitting diode driving unit is electrically connected to the direct current power input contact, the light emitting diodes and the first light emitting diode driving unit.

The first light emitting diode driving unit includes a plurality of first light emitting diode driving subunits. The first light emitting diode driving subunits are electrically connected to each other in series. The first light emitting diode driving subunits are electrically connected to the direct current power input contact, the light emitting diodes, the light signal control unit and the second light emitting diode driving unit. The second light emitting diode driving unit includes a light signal conversion subunit and a plurality of second light emitting diode driving subunits. The light signal conversion subunit is electrically connected to the direct current power input contact and the first light emitting diode driving unit. The second light emitting diode driving subunits are electrically connected to each other in series. The second light emitting diode driving subunits are electrically connected to the direct current power input contact, the light emitting diodes and the first light emitting diode driving unit. The light signal control unit, the first light emitting diode driving unit and the second light emitting diode driving unit are electrically connected in parallel to receive the direct current power. The light signal control unit sends a light signal to the first light emitting diode driving unit, and then the first light emitting diode driving unit sends the light signal to the second light emitting diode driving unit, so that the light signal is transmitted between the first light emitting diode driving unit and the second light emitting diode driving unit in series. The first light emitting diode driving subunits and the second light emitting diode driving subunits drive the light emitting diodes according to the light signal. The light signal conversion subunit boosts a voltage of the light signal, so that the light signal is sent to the second light emitting diode driving subunits.

The efficiency of the present invention is to combine the advantages of the serial-type light emitting diode lamp string module (having a small current) and the parallel-type light emitting diode lamp string module (having a constant working voltage), so that the circuit design is simple and the cost is reduced.

DETAILED DESCRIPTION OF THE INVENTION

Figure 1:
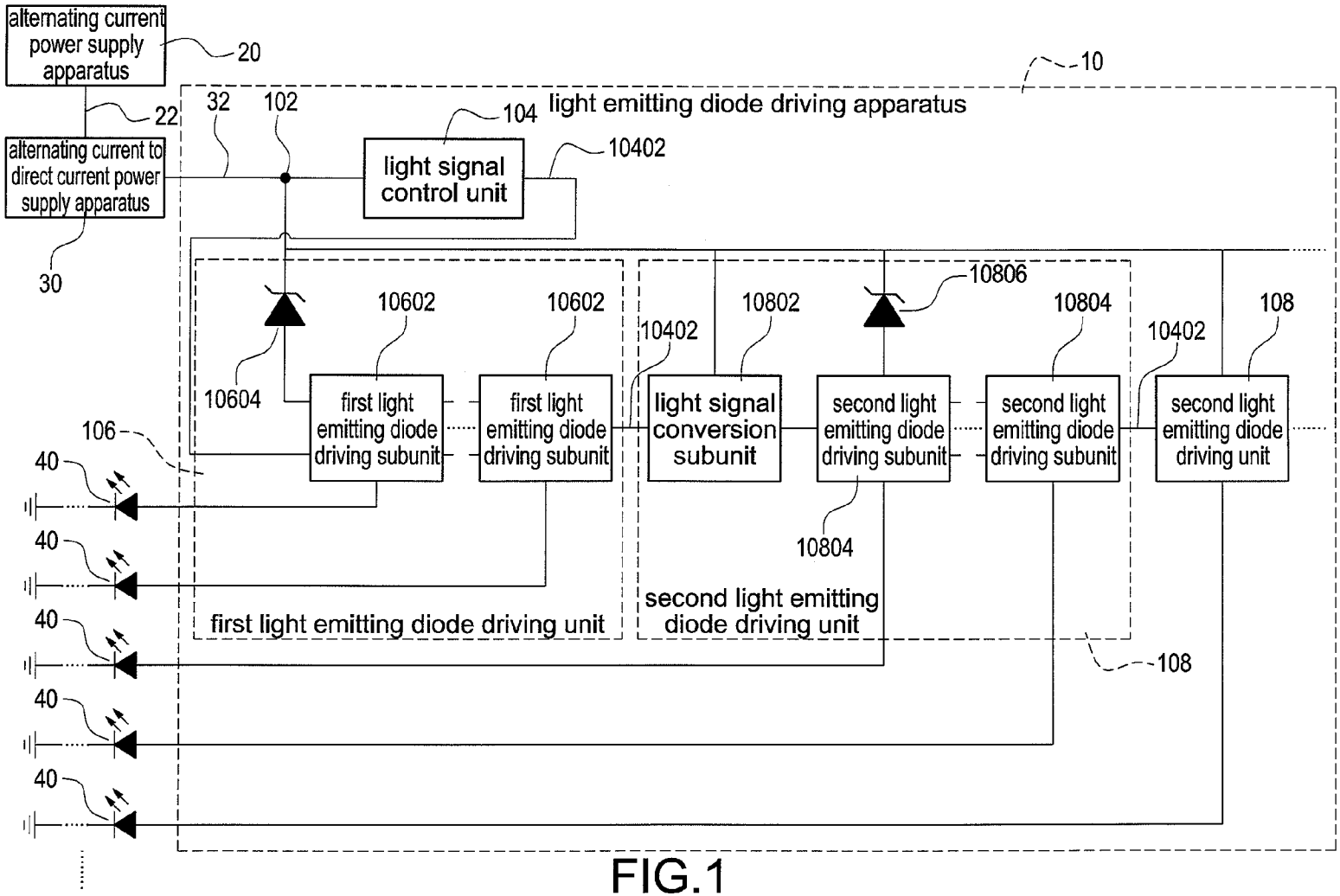
FIG. 1 shows a block diagram of the light emitting diode driving apparatus of the present invention.

FIG. 1 shows a block diagram of the light emitting diode driving apparatus of the present invention. A light emitting diode driving apparatus 10 is applied to an alternating current power supply apparatus 20, an alternating current to direct current power supply apparatus 30 and a plurality of light emitting diodes 40. The alternating current power supply apparatus 20 sends an alternating current power 22 to the alternating current to direct current power supply apparatus 30. The alternating current to direct current power supply apparatus 30 converts the alternating current power 22 into a direct current power 32.

The light emitting diode driving apparatus 10 comprises a direct current power input contact 102, a light signal control unit 104, a first light emitting diode driving unit 106 and at lease a second light emitting diode driving unit 108.

The direct current power input contact 102 is electrically connected to the alternating current to direct current power supply apparatus 30 to receive the direct current power 32. The light signal control unit 104 is electrically connected to the direct current power input contact 102. The first light emitting diode driving unit 106 is electrically connected to the direct current power input contact 102, the light emitting diodes 40 and the light signal control unit 10. The second light emitting diode driving unit 108 is electrically connected to the direct current power input contact 102, the light emitting diodes 40 and the first light emitting diode driving unit 106.

The first light emitting diode driving unit 106 includes a plurality of first light emitting diode driving subunits 10602 and a first voltage regulation subunit 10604.

The first light emitting diode driving subunits 10602 are electrically connected to each other in series. The first light emitting diode driving subunits 10602 are electrically connected to the direct current power input contact 102, the light emitting diodes 40, the light signal control unit 104 and the second light emitting diode driving unit 108. The first voltage regulation subunit 10604 is electrically connected to the direct current power input contact 102 and the first light emitting diode driving subunit 10602. The first voltage regulation subunit 10604 is, for example but not limited to, a Zener diode.

The second light emitting diode driving unit 108 includes a light signal conversion subunit 10802, a plurality of second light emitting diode driving subunits 10804 and a second voltage regulation subunit 10806.

The light signal conversion subunit 10802 is electrically connected to the direct current power input contact 102 and the first light emitting diode driving unit 106. The second light emitting diode driving subunits 10804 are electrically connected to each other in series. The second light emitting diode driving subunits 10804 are electrically connected to the direct current power input contact 102, the light emitting diodes 40 and the first light emitting diode driving unit 106. The second voltage regulation subunit 10806 is electrically connected to the direct current power input contact 102 and the second light emitting diode driving subunit 10804. The second voltage regulation subunit 10806 is, for example but not limited to, a Zener diode.

The light signal control unit 104, the first light emitting diode driving unit 106 and the second light emitting diode driving unit 108 are electrically connected in parallel to receive the direct current power 32.

The light signal control unit 104 sends a light signal 10402 to the first light emitting diode driving unit 106, and then the first light emitting diode driving unit 106 sends the light signal 10402 to the second light emitting diode driving unit 108, so that the light signal 10402 is transmitted between the first light emitting diode driving unit 106 and the second light emitting diode driving unit 108 in series.

The first light emitting diode driving subunits 10602 and the second light emitting diode driving subunits 10804 drive the light emitting diodes 40 according to the light signal 10402. The light signal conversion subunit 10802 boosts a voltage of the light signal 10402, so that the light signal 10402 is sent to the second light emitting diode driving subunits successfully. For example, the voltage of the light signal 10402 is boosted to be higher than a working voltage of the second light emitting diode driving subunit 10804.

Moreover, a first of the second light emitting diode driving units 108 is connected to the direct current power input contact 102, the light emitting diodes 40 and the first light emitting diode driving unit 106. The remaining second light emitting diode driving units 108 are connected to the direct current power input contact 102, the light emitting diodes 40 and a previous second light emitting diode driving unit 108.

A first of the first light emitting diode driving subunits 10602 is connected to the direct current power input contact 102, the light emitting diodes 40 and the light signal control unit 104. A last of the first light emitting diode driving subunits 10602 is connected to the light emitting diodes 40, a previous first light emitting diode driving subunit 10602 and the first of the second light emitting diode driving units 108. The remaining first light emitting diode driving subunits 10602 are connected to the light emitting diodes 40 and the previous first light emitting diode driving subunit 10602.

The light signal conversion subunit 10802 of the first of the second light emitting diode driving units 108 is connected to the direct current power input contact 102 and the last of the first light emitting diode driving subunits 10602 of the first light emitting diode driving unit 106. The light signal conversion subunits 10802 of the remaining second light emitting diode driving units 108 are connected to the direct current power input contact 102 and the previous second light emitting diode driving unit 108.

A first of the second light emitting diode driving subunits 10804 is connected to the direct current power input contact 102, the light emitting diodes 40 and the light signal conversion subunit 10802. A last of the second light emitting diode driving subunits 10804 is connected to the light emitting diodes 40, a previous second light emitting diode driving subunit 10804 and the light signal conversion subunit 10802 of a next second light emitting diode driving unit 108. The remaining second light emitting diode driving subunits 10804 are connected to the light emitting diodes 40 and the previous second light emitting diode driving subunit 10804.

The light emitting diode 40 mentioned above can be a packaged light emitting diode unit or a light emitting diode chip. The light emitting diode 40 can be integrated with the first light emitting diode driving subunit 10602 or the second light emitting diode driving subunit 10804 as a packaged light emitting diode unit when the light emitting diode 40 is a light emitting diode chip.

Figure 2:
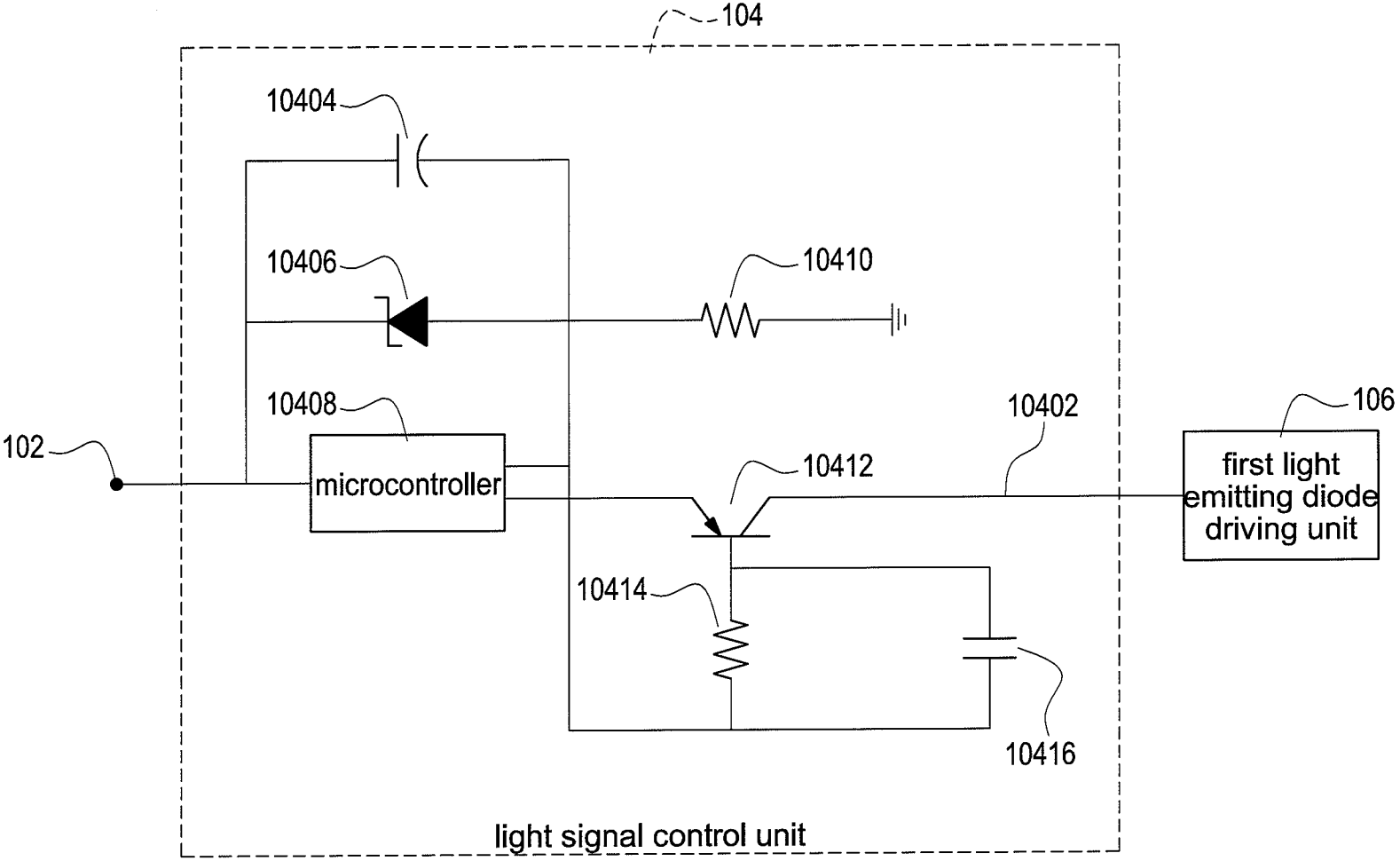
FIG. 2 shows a block diagram of the light signal control unit of the present invention.

FIG. 2 shows a block diagram of the light signal control unit of the present invention. The light signal control unit 104 comprises a first capacitor 10404, a first Zener diode 10406, a microcontroller 10408, a first resistor 10410, a first transistor 10412, a second resistor 10414 and a second capacitor 10416.

The first capacitor 10404 is electrically connected to the direct current power input contact 102. The first Zener diode 10406 is electrically connected to the direct current power input contact 102. The microcontroller 10408 is electrically connected to the direct current power input contact 102. The first resistor 10410 is electrically connected to the first capacitor 10404, the first Zener diode 10406 and the microcontroller 10408. The first transistor 10412 is electrically connected to the microcontroller 10408 and the first light emitting diode driving unit 106. The second resistor 10414 is electrically connected to the first transistor 10412. The second capacitor 10416 is electrically connected to the first transistor 10412.

Figure 3:
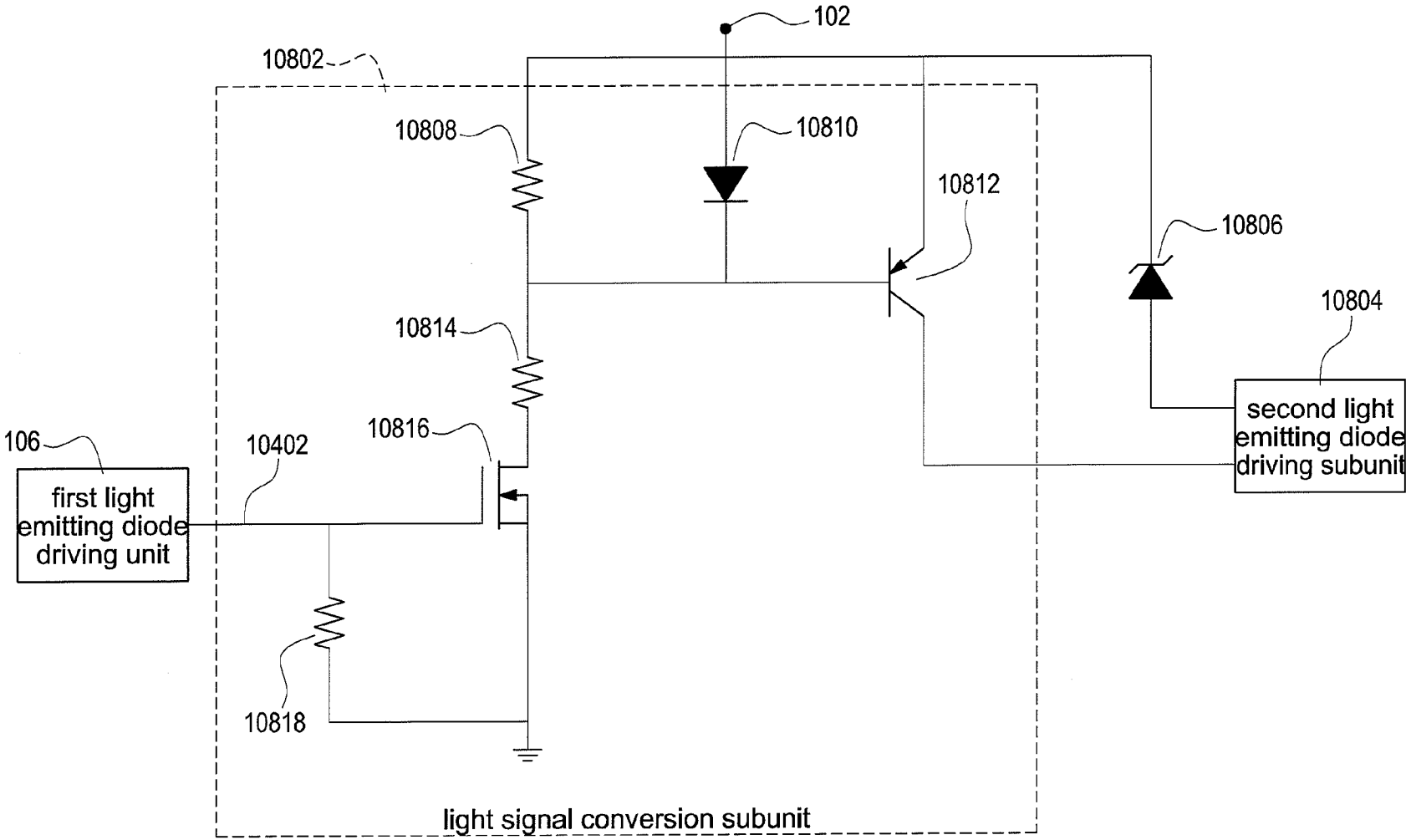
FIG. 3 shows a block diagram of the first embodiment of the light signal conversion subunit of the present invention.

FIG. 3 shows a block diagram of the first embodiment of the light signal conversion subunit of the present invention. The light signal conversion subunit 10802 comprises a third resistor 10808, a first diode 10810, a second transistor 10812, a fourth resistor 10814, a third transistor 10816 and a fifth resistor 10818.

The third resistor 10808 is electrically connected to the direct current power input contact 102. The first diode 10810 is electrically connected to the direct current power input contact 102. The second transistor 10812 is electrically connected to the direct current power input contact 102 and the second light emitting diode driving subunit 10804. The fourth resistor 10814 is electrically connected to the third resistor 10808, the first diode 10810 and the second transistor 10812. The third transistor 10816 is electrically connected to the fourth resistor 10814 and the first light emitting diode driving unit 106. The fifth resistor 10818 is electrically connected to the third transistor 10816 and the first light emitting diode driving unit 106.

Figure 4:
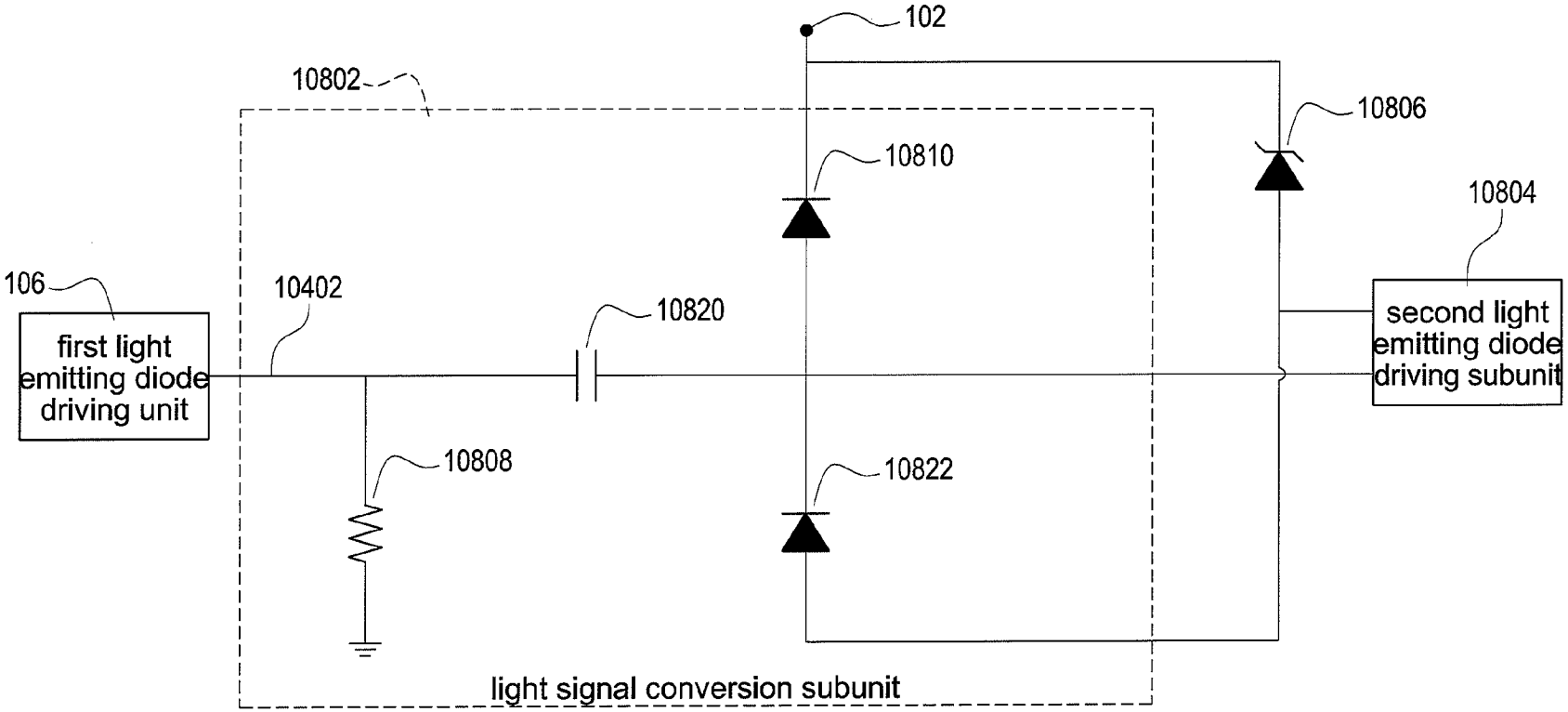
FIG. 4 shows a block diagram of the second embodiment of the light signal conversion subunit of the present invention.

FIG. 4 shows a block diagram of the second embodiment of the light signal conversion subunit of the present invention. The light signal conversion subunit 10802 comprises a third resistor 10808, a first diode 10810, a third capacitor 10820 and a second diode 10822.

The third resistor 10808 is electrically connected to the first light emitting diode driving unit 106. The first diode 10810 is electrically connected to the direct current power input contact 102. The third capacitor 10820 is electrically connected to the third resistor 10808, the first light emitting diode driving unit 106, the first diode 10810 and the second light emitting diode driving subunit 10804. The second diode 10822 is electrically connected to the third capacitor 10820, the first diode 10810 and the second light emitting diode driving subunit 10804.

The advantage of the present invention is to combine the advantages of the serial-type light emitting diode lamp string module (having a small current) and the parallel-type light emitting diode lamp string module (having a constant working voltage), so that the circuit design is simple and the cost is reduced.

Although the present invention has been described with reference to the preferred embodiment thereof, it will be understood that the invention is not limited to the details thereof. Various substitutions and modifications have been suggested in the foregoing description, and others will occur to those of ordinary skill in the art. Therefore, all such substitutions and modifications are intended to be embraced within the scope of the invention as defined in the appended claims.

What is claimed is:

1. A light emitting diode driving apparatus applied to an alternating current power supply apparatus and a plurality of light emitting diodes, the light emitting diode driving apparatus comprising:

a single alternating current to direct current power supply apparatus, the alternating current power supply apparatus sending an alternating current power to the single alternating current to direct current power supply apparatus, the single alternating current to direct current power supply apparatus converting the alternating current power into a direct current power;

a direct current power input contact electrically connected to the single alternating current to direct current power supply apparatus to receive the direct current power;

a light signal control unit electrically connected to the direct current power input contact;

a first light emitting diode driving unit electrically connected to the direct current power input contact, the light emitting diodes and the light signal control unit; and at least a second light emitting diode driving unit electrically connected to the direct current power input contact, the light emitting diodes and the first light emitting diode driving unit, wherein the first light emitting diode driving unit comprises:

a plurality of first light emitting diode driving subunits electrically connected to each other in series and electrically connected to the direct current power input contact, the light emitting diodes, the light signal control unit and the second light emitting diode driving unit, wherein the second light emitting diode driving unit comprises:

a light signal conversion subunit electrically connected to the direct current power input contact; and a plurality of second light emitting diode driving subunits electrically connected to each other in series and electrically connected to the direct current power input contact, the light emitting diodes and the first light emitting diode driving unit, wherein the light signal control unit, the first light emitting diode driving unit and the second light emitting diode driving unit are electrically connected in parallel to receive the direct current power through the direct current power input contact;

wherein the light signal control unit sends a light signal to the first light emitting diode driving unit, and then the first light emitting diode driving unit sends the light signal to the second light emitting diode driving unit, so that the light signal is transmitted between the first light emitting diode driving unit and the second light emitting diode driving unit in series; and wherein the first light emitting diode driving subunits and the second light emitting diode driving subunits drive the light emitting diodes according to the light signal; the light signal conversion subunit is connected to a first of the second light emitting diode driving units and a last of the first light emitting diode driving subunits in series; the light signal conversion subunit boosts a voltage of the light signal, so that the light signal is sent to the first of the second light emitting diode driving subunits from the last of the first light emitting diode driving subunits.

2. The light emitting diode driving apparatus in claim 1, wherein the first light emitting diode driving unit further comprises a first voltage regulation subunit electrically connected to the direct current power input contact and the first light emitting diode driving subunit.

3. The light emitting diode driving apparatus in claim 2, wherein the first voltage regulation subunit is a zener diode.

4. The light emitting diode driving apparatus in claim 1, wherein the second light emitting diode driving unit further comprises a second voltage regulation subunit electrically connected to the direct current power input contact and the second light emitting diode driving subunit.

5. The light emitting diode driving apparatus in claim 4, wherein the second voltage regulation subunit is a zener diode.

6. The light emitting diode driving apparatus in claim 1, wherein the light signal control unit comprises:

a first capacitor electrically connected to the direct current power input contact;

a first zener diode electrically connected to the direct current power input contact; and a microcontroller electrically connected to the direct current power input contact.

7. The light emitting diode driving apparatus in claim 6, wherein the light signal control unit further comprises:

a first resistor electrically connected to the first capacitor, the first zener diode and the microcontroller;

a first transistor electrically connected to the microcontroller and the first light emitting diode driving unit;

a second resistor electrically connected to the first transistor; and a second capacitor electrically connected to the first transistor.

8. The light emitting diode driving apparatus in claim 7, wherein the light signal conversion subunit comprises:

a third resistor electrically connected to the direct current power input contact;

a first diode electrically connected to the direct current power input contact; and a second transistor electrically connected to the direct current power input contact and the second light emitting diode driving subunit.

9. The light emitting diode driving apparatus in claim 8, wherein the light signal conversion subunit further comprises:

a fourth resistor electrically connected to the third resistor, the first diode and the second transistor;

a third transistor electrically connected to the fourth resistor and the first light emitting diode driving unit; and a fifth resistor electrically connected to the third transistor and the first light emitting diode driving unit.

10. The light emitting diode driving apparatus in claim 7, wherein the light signal conversion subunit comprises:

a third resistor electrically connected to the first light emitting diode driving unit;

a first diode electrically connected to the direct current power input contact;

a third capacitor electrically connected to the third resistor, the first light emitting diode driving unit, the first diode and the second light emitting diode driving subunit; and a second diode electrically connected to the third capacitor, the first diode and the second light emitting diode driving subunit.

11. The light emitting diode driving apparatus in claim 1, wherein the voltage of the light signal is boosted to be higher than a working voltage of the second light emitting diode driving subunit.

* * * * *